US012349826B2

(12) United States Patent
Torrence

(10) Patent No.: US 12,349,826 B2
(45) Date of Patent: Jul. 8, 2025

(54) ADJUSTABLE QUILT

(71) Applicant: Zenbivy LLC, Spokane, WA (US)

(72) Inventor: Kylie Torrence, Bellingham, WA (US)

(73) Assignee: ZENBIVY LLC, Spokane, WA (US)

( * ) Notice: Subject to any disclaimer, the term of this patent is extended or adjusted under 35 U.S.C. 154(b) by 280 days.

(21) Appl. No.: 17/872,349

(22) Filed: Jul. 25, 2022

(65) Prior Publication Data

US 2023/0067879 A1 Mar. 2, 2023

Related U.S. Application Data

(60) Provisional application No. 63/240,299, filed on Sep. 2, 2021.

(51) Int. Cl.
*A47G 9/04* (2006.01)
*A47G 9/02* (2006.01)

(52) U.S. Cl.
CPC ..... *A47G 9/04* (2013.01); *A47G 9/0223* (2013.01)

(58) Field of Classification Search
CPC ..... A47G 9/086; A47G 9/0207; A47G 9/04; A47G 9/0223; A47G 9/08; A41D 15/04; A41B 13/06; A45F 4/00; A45F 3/22
USPC ..... 5/413 R, 413 AM, 420, 482, 417, 421, 5/485, 494, 502, 625; 2/69.5
See application file for complete search history.

(56) References Cited

U.S. PATENT DOCUMENTS 3,831,206 A * 8/1974 Geary ..... A47G 9/086 5/413 R
4,484,362 A * 11/1984 Asher ..... A45F 3/22 5/413 R
4,787,105 A * 11/1988 Phillips ..... A47G 9/086 5/413 R
5,735,003 A * 4/1998 Judge ..... A47G 9/086 5/413 AM
5,815,833 A * 10/1998 Kuo ..... A47G 9/086 5/413 AM
6,018,830 A * 2/2000 Howe ..... A47G 9/086 5/413 R (Continued)

FOREIGN PATENT DOCUMENTS

CN 112672666 A * 4/2021 ..... A47G 9/0207

OTHER PUBLICATIONS

Duraton Store—Mummy Sleeping Bax, Amazon, www.amazon.com/DURATON-Sleeping-Lightweight-Compression-Backpacking/dp/B07T1LZMTR?th=1 (Year: 2017).*

(Continued)

*Primary Examiner* — Madison Emanski
(74) *Attorney, Agent, or Firm* — Armstrong Teasdale LLP

(57) ABSTRACT

A sleeping quilt includes an outer layer having an undrawn lateral width extending from a first longitudinal edge to an opposing second longitudinal edge and a drawcord having an undrawn lateral width. The drawcord being fixed to the outer layer at a first point and a second point laterally distal to the first point. Each of the first point and the second point is located a gap distance medially inward from the first longitudinal edge and the second longitudinal edge, respectively. The outer layer has a gatherable portion that is defined between the first point and the second point. A first undrawable portion is defined between the first point and the first longitudinal edge and a second undrawable portion is defined between the second point and the second longitudinal edge.

17 Claims, 8 Drawing Sheets

(56) References Cited

U.S. PATENT DOCUMENTS

| | | | | |
|---|---|---|---|---|
| 2008/0078027 | A1* | 4/2008 | Smith | A41D 15/04 5/413 R |
| 2009/0255059 | A1* | 10/2009 | Ascroft | A47G 9/086 5/413 R |
| 2010/0256716 | A1* | 10/2010 | Haislip | A47G 9/086 5/413 R |
| 2011/0173749 | A1* | 7/2011 | Martray | A47G 9/086 5/413 R |
| 2012/0297539 | A1* | 11/2012 | Like | A47G 9/086 5/413 R |
| 2014/0033395 | A1* | 2/2014 | Torgersen | A41D 11/00 2/69.5 |
| 2018/0192796 | A1* | 7/2018 | Glavin | A47G 9/08 |
| 2020/0022512 | A1* | 1/2020 | Glavin | A47G 9/0223 |

OTHER PUBLICATIONS

"Big Agnes Fussell UL Quilt." Youtube, https://www.youtube.com/watch?v=sxrab7f-CVI (Year: 2020).*

"UGQ Bandit Top Quilt Review | A Perfect Quilt ?. " Youtube, https://www.youtube.com/watch?v=cL1XA9wKjaE (Year: 2019).*

* cited by examiner

ADJUSTABLE QUILT

CROSS-REFERENCE TO RELATED APPLICATION

This application claims priority to U.S. Provisional Patent Application No. 63/240,299, filed Sep. 2, 2021, which is incorporated herein by reference in its entirety.

FIELD

The field of this disclosure relates generally to quilts and, more particularly, to a quilt including a drawcord for selectively adjusting a width of a portion of the quilt.

BACKGROUND

Conventional sleeping bags include rectangular sleeping bags, semi-rectangular sleeping bags, and mummy-type sleeping bags. Larger bags are often more comfortable and allow more freedom of movement, and smaller bags are typically more thermally efficient due to a smaller interior volume that is heated by a user's body. The user therefore has to compromise, or acquire multiple different bags suitable for different temperature and climate conditions; given conventional sleeping bag are not readily adaptable to even a moderate range of temperature and climate conditions. Furthermore, even with larger sleeping bag being suitable for the particular temperature and climate conditions, a sleeping bag is nevertheless more restrictive and less comfortable relative to traditional bedding, and the sleeping bag does not readily accommodate various sleeping positions.

Unlike conventional sleeping bags, quilts are commonly a rectangular covering adapted to keep a user warm, especially while sleeping by laying the quit over the user. While many quilts are intended for indoor use, quilts can also be used in the outdoors by backpackers, hikers, campers, mountaineers, and other users as portable bedding or coverings. Outdoor quilts are often durable, soft, thermally insulated for a particular temperature and climate rating, and weather resistant. Outdoor users commonly prefer quilts over conventional sleeping bags because quilts tend to be lighter in weight/volume and more comfortable. By way of example, quilts are substantially less restrictive during use than a conventional sleeping bag (e.g., a mummy bag).

Conventional quilts do not include means of drawing or gathering the quilt around the user's neck or shoulders. As a result, conventional quilts are susceptible to drafts and allowing heat to escape from around the user's body. Known quilts that are adapted to reduce this loss of heat reduce the user's mobility due to their restrictive nature. Such known quilts have a drawcord across the quilt's entire span that enables the user to draw or gather the quilt around their body, thereby reduce heat loss, which causes restriction around the user's body that can cause discomfort.

Accordingly, a need exists for a quilt that can selectively gather across a width of a portion of the quilt for comfort and warmth.

SUMMARY

In one embodiment, a sleeping quilt is disclosed. The sleeping quilt includes an outer layer having an undrawn lateral width extending from a first longitudinal edge to an opposing second longitudinal edge. The quilt further includes a drawcord having an undrawn lateral width, and the is drawcord being to the outer layer at a first point and a second point laterally distal to the first point. Each of the first point and the second point is located a gap distance medially inward from the first longitudinal edge and the second longitudinal edge, respectively. The outer layer comprises a gatherable portion defined between the first point and the second point. A first undrawable portion is defined between the first point and the first longitudinal edge and a second undrawable portion is defined between the second point and the second longitudinal edge.

In another embodiment, a sleeping quilt is disclosed. The sleeping quilt includes a drawcord extending laterally across a portion of a width of the quilt. The drawcord has an undrawn lateral width, and the drawcord is fixed to the quilt at a first point and a second point laterally distal to the first point. Each of the first point and the second point is located a gap distance medially inward from a first longitudinal edge and a second longitudinal edge of the quilt. The quilt further includes a gatherable portion defined between the first point and the second point.

In yet another embodiment, a sleeping quilt is disclosed. The sleeping quilt includes an undrawn lateral width extending from a first longitudinal edge to an opposing second longitudinal edge. The quilt further includes a drawcord extending laterally across a portion of a width of the quilt. The drawcord has an undrawn lateral width, and the drawcord i fixed to the quilt at a first point and a second point laterally distal to the first point. Each of the first point and the second point are located a gap distance medially inward from the first longitudinal edge and the second longitudinal edge of the quilt. The quilt further includes a gatherable portion defined between the first point and the second point. The drawcord is secured at two pull points at opposing ends of the drawcord. The pull points are located in a range of about 4 inches to about 16 inches medially inward from a first longitudinal side edge and a second longitudinal side edge.

DETAILED DESCRIPTION

For purposes of the present disclosure, the terms top, bottom, up, down, above, below and the like are defined relative to a generally horizontal surface (e.g., the ground, floor, or surface etc.) on which a quilt is positioned for a user to occupy.

As used herein, the term "longitudinal" shall indicate a direction extending along an axis or plane defined by the length of an element of the present disclosure, such as the length of the quilt. As used herein, the term "midline" shall indicate a median line or plane of bilateral symmetry of an element of the present disclosure, such as the quilt.

As used herein, the terms "headward" and "footward" designate opposite longitudinal directions along a longitudinal length of the quilt or its components, with headward indicating the direction (or end) toward which the head of the user occupying the quilt commonly would intentionally be positioned, and footward indicating the opposite direction (or end), toward which the feet of the user occupying the quilt commonly would intentionally be positioned.

As used herein, the term "transverse" indicates a direction generally horizontal and generally orthogonal to the headward/footward directions.

As used herein, "lateral" indicates a position along a structure or object that is located farther transversely from a longitudinal midline of the quilt, while "medial" indicates a position along the structure or object that is located closer transversely to the longitudinal midline of the quilt.

As used herein, movement or conversion "between" a first configuration or arrangement and a second configuration or arrangement includes both (i) movement or conversion from the first configuration or arrangement to the second configuration or arrangement and (ii) movement or conversion from the second configuration or arrangement to the first configuration or arrangement.

Figure 1:
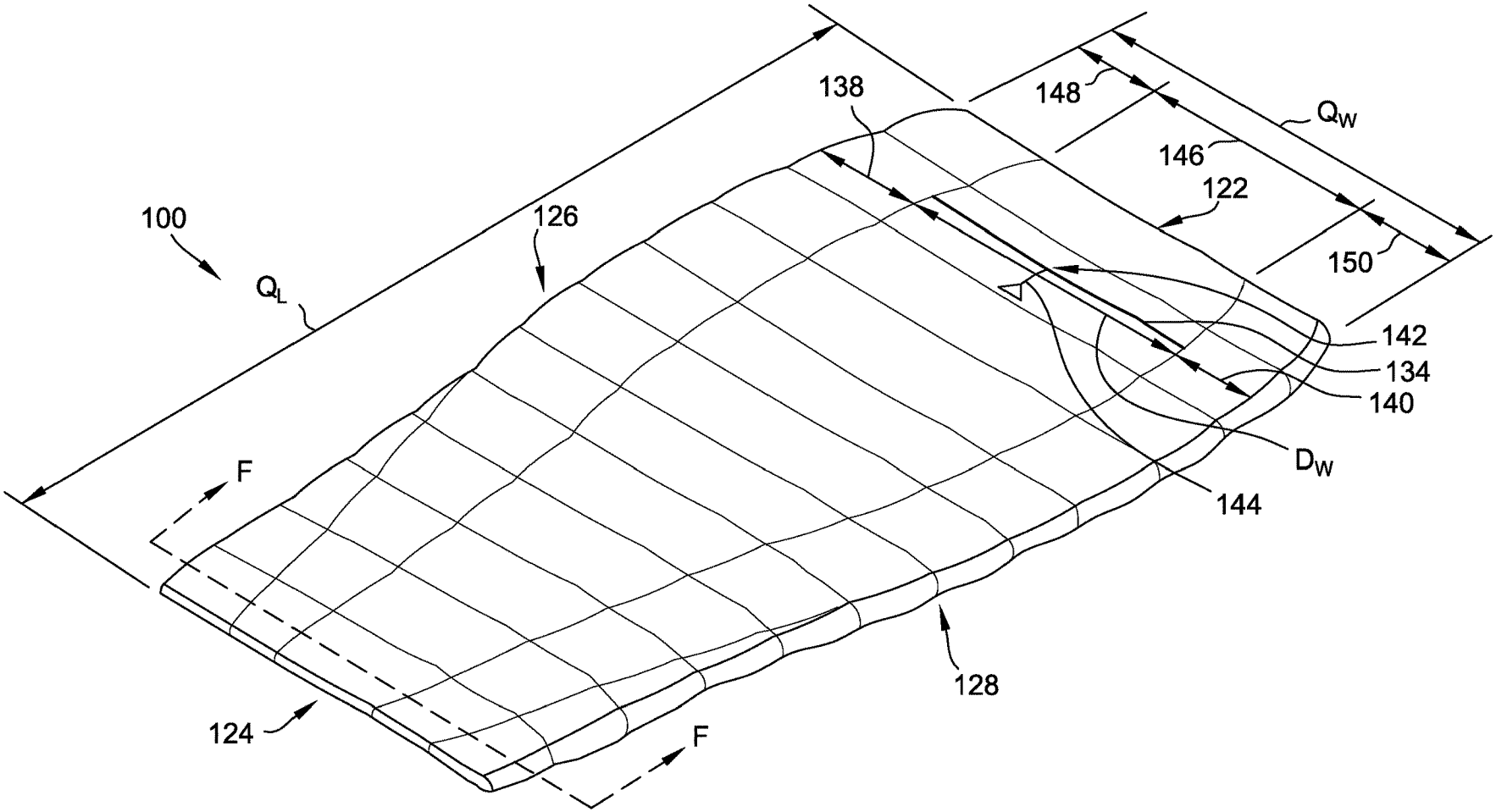
FIG. 1 is a perspective view of a quilt in accordance with one or more embodiments of the present disclosure.

Referring now to the drawings and in particular to FIG. 1, one embodiment of a quilt of the present disclosure is designated in its entirety by the reference number 100. The quilt 100 has a longitudinal length $Q_L$ and a lateral width $Q_W$. In one embodiment, the quilt 100 has a headward end 122, a footward end 124, first longitudinal side edge 126, and second longitudinal side edge 128. The headward end 122 and the footward end 124 are laterally extending on opposing ends of the quilt 100 and can have the same or different lateral widths $Q_W$. In some embodiments, the first and second side edges 126, 128 are longitudinally extending on opposing sides of the quilt 100 and can have the same or different longitudinal lengths $Q_L$.

Figure 2:
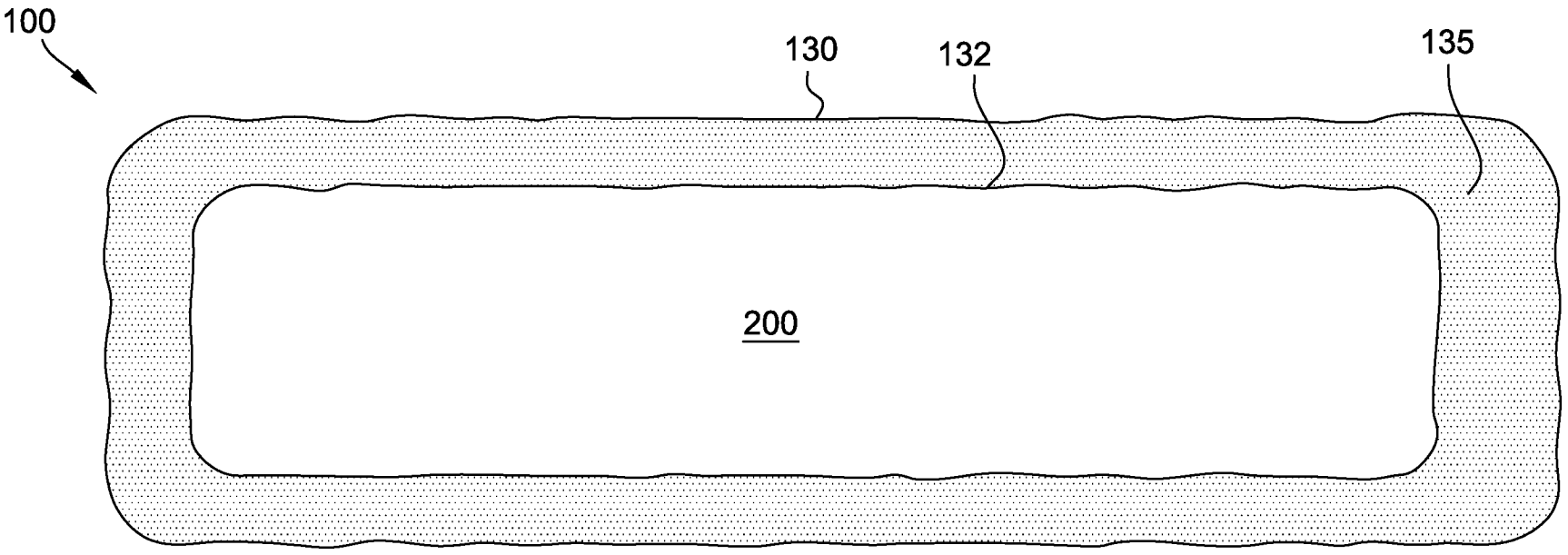
FIG. 2 is a section view of the quilt of FIG. 1 taken along Section F-F.
Figure 4:
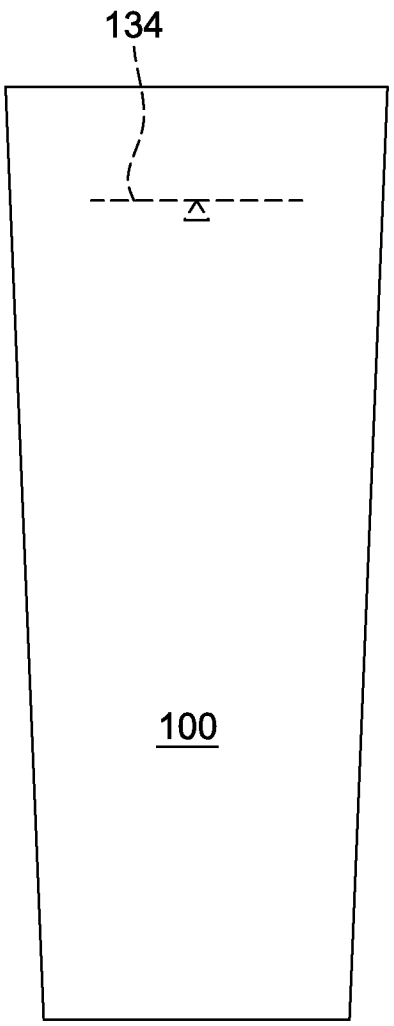
FIG. 4 is a bottom plan view of the quilt.
Figure 3:
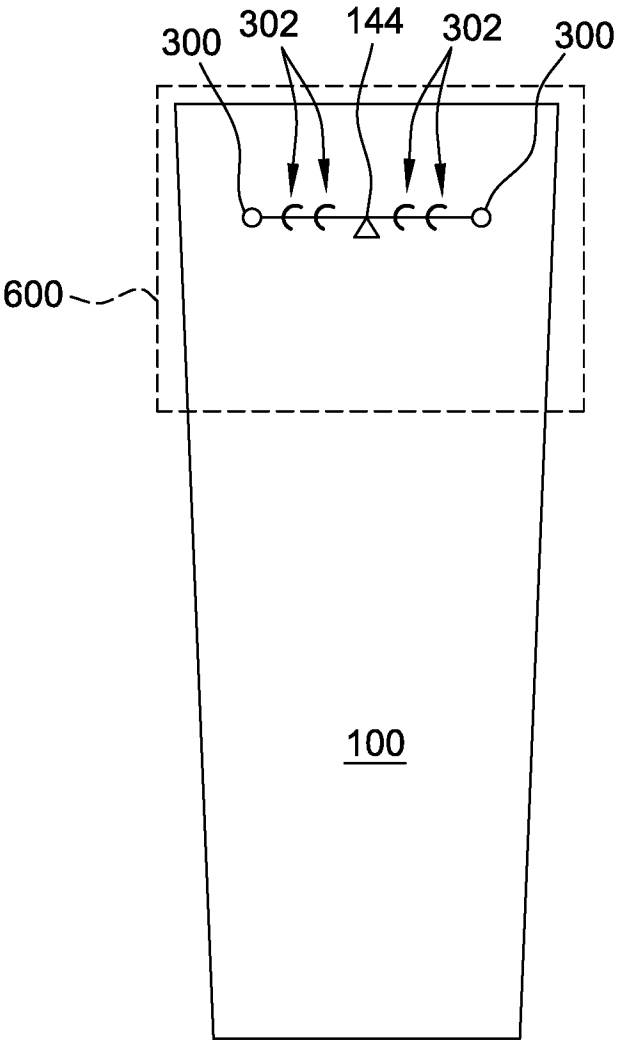
FIG. 3 is a top plan view of the quilt.

In some embodiments, for example as illustrated in FIGS. 1 through 3, the quilt 100 has a tapered shape from the headward end 122 to the footward end 124, such that the lateral width $Q_W$ is greater at the headward end 122 than the lateral width $Q_W$ at the footward end 124. In some embodiments, there is a continuous taper from the headward end 122 to the footward end 124. In other embodiments, the taper can begin at any location along the longitudinal length $Q_L$ of the quilt 100 and the taper can extend from a portion of the longitudinal length $Q_L$. In some embodiments, the tapered shape is configured to generally conform to the contours of a human body. In some embodiments, a ratio of the width $Q_W$ of the headward end to the width $Q_W$ of the footward end (reffered to as a "taper ratio") is in the range of 1.1:1 to 4:1 or any other suitable ratio that allows for the quilt to function as described herein. In other embodiments, the quilt 100 can have a taper ratio less than 1.1:1 or greater than 4:1 or no taper at all (e.g., parallel sides). By way of example, but not limitation, in some embodiments, the quilt 100 can be generally rectangular. In some embodiments, quilt 100 is a "regular" size quilt adapted to fit users from about 5 feet to about 6 feet tall. However, in other embodiments, the quilt 100 is adapted (e.g., shorter, longer, wider, narrower) more specifically for men, women, or youth sizes.

In some embodiments, as shown in FIG. 2, which is a section view of the quilt 100 taken along section F-F of FIG. 1, the quilt 100 has an outer layer 130 and an inner layer 132. In some embodiments, the outer layer 130 comprises a tear or rip preventative material, such as ripstop nylon or the like and can be waterproof or water resistant. In some embodiments, the inner layer 132 comprises the same material as the outer layer 130. However, in some other suitable embodiments, the inner layer can comprise a different material to provide a soft or smooth feeling to the user.

In some embodiments, the quilt 100 includes an insulating material 135 disposed between the outer layer 130 and the inner layer 132, to provide warmth and softness to the quilt 100. The insulating material 135, in some embodiments, is secured to the outer and/or inner layers 130, 132 of the quilt 100 using stitching and/or adhesives or the like. In some embodiments, the outer and inner layers 30, 32 can be any suitable material (e.g., polyester). In some embodiments, the outer layer 30 can be made from a different material than the inner layer 32. By way of example, but not limitation, if the inner layer 32 is configured to be the layer in greater contact with the user during normal use, the inner layer 32 can be of a softer material than the outer layer 30. In some embodiments, the insulation material can be any suitable material (e.g., goose down, CLOUDLOFT™ insulation, DRIDOWN™ insulation) and the amount and thickness of insulating material 135 can be selected to achieve the desired warmth, softness, and weight of the quilt 100. As shown in FIG. 2, the quilt 100 can be sewn in a manner to create a cavity 200 sized to allow the user to fit therein, such as a sleeping bag configuration. In other embodiments, the quilt 100 is a flat sheet style quilt with no cavity 200.

Any one or more materials (e.g., fabrics or insulators) suitable for constructing a conventional sleeping bag or quilt can be employed for constructing one or more components of the quilt 100. By way of example, but not limitation, such materials can include: nylon, polyester, silk, cotton, taffeta, ripstop, pongee, flannel, microfiber, GORE-tex®, or fleece; natural down, synthetic insulation, or other insulating material; or metal-coated polymer film or other thermally shielding or thermally reflective material. In some embodiments, one or more of the outer layer 130, the inner layer 132 or the insulating material 135 can include heating elements, such as electrical or chemical heating elements.

Figure 12:
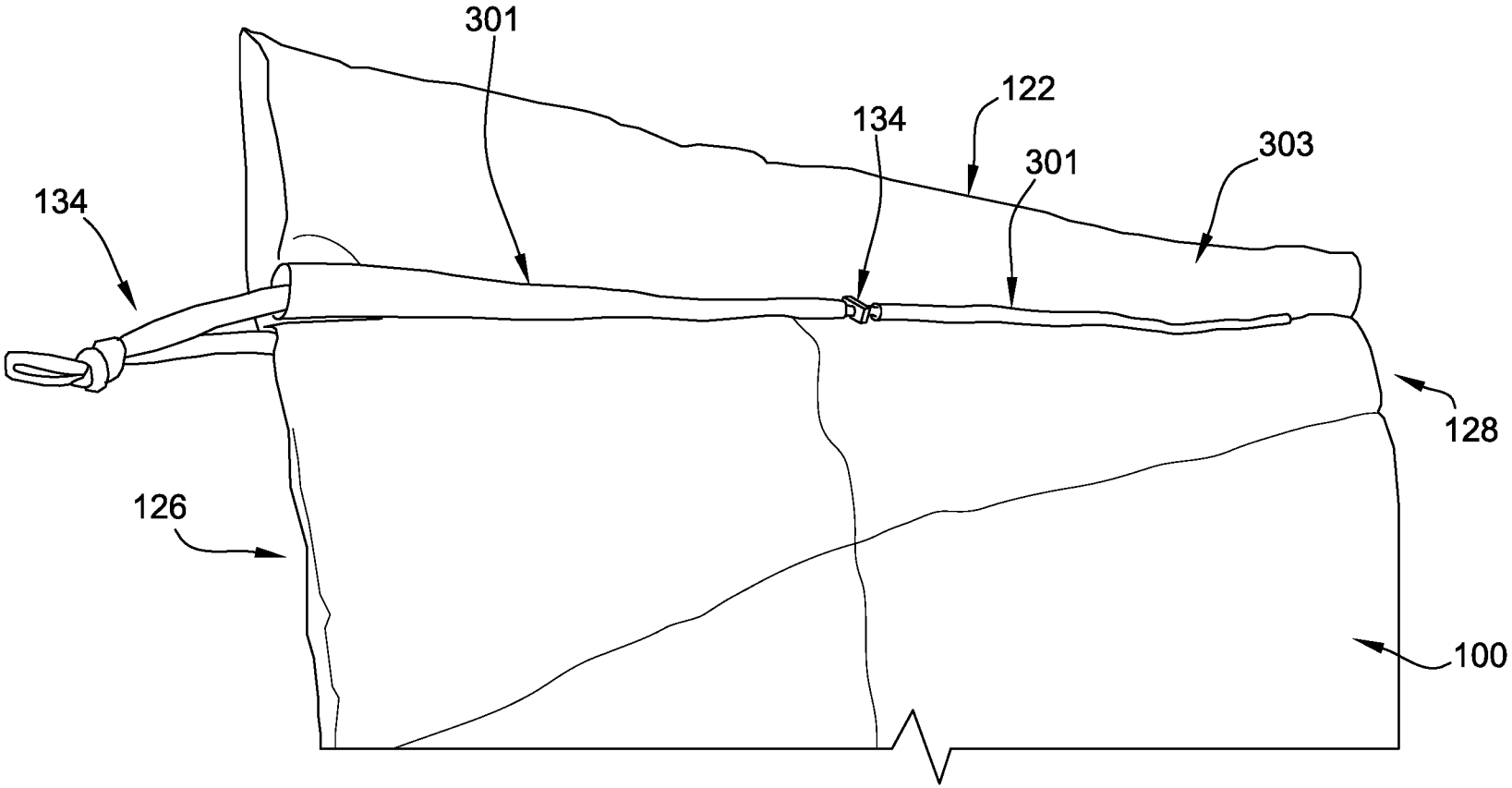
FIG. 12 is a perspective view of a quilt in accordance with one or more embodiments of the present disclosure.

With reference again to FIG. 1, the quilt 100 includes a drawcord 34 that extends laterally a width $D_W$ across a portion of the width $Q_W$ of the quilt 100. The drawcord 134 is spaced longitudinally from the head edge 22 by a head-to-cord gap length 136. In some embodiments, the head-to-cord gap length 136 is in the range of about 2 inches to about 20 inches, such as 4 inches, 6 inches, 8 inches, 10 inches, 12, inches, 14 inches, 16 inches, or 18 inches but can be less than or greater than these amounts in other suitable embodiments. In some embodiments, the portion of the quilt defined longitudinally by head-to-cord gap length 136, and the width $Q_W$ is a baffle portion 303 (as shown in FIG. 12) that creates a soft edge for resting against the user, such as the user's neck or chin area. As further illustrated in FIG. 1, the drawcord 134 does not extend laterally across the entire width $Q_W$ of the quilt 100. As a result, he drawcord 134 is spaced laterally from the first side edge 126 by a first undrawable width 138, and from the second side edge 128 by a second undrawable width 140, which can be the same or different width as first undrawable width 138. In some embodiments, the first undrawable width 138 and the second undrawable width 140 can each range from at least 1 inch to 16 inches, such as about 2 inches, 4 inches, 6 inches, 8 inches, 10 inches, or 12 inches or greater. In the illustrated embodiment, the first longitudinal side edge 126 and the first undrawable width 138 are generally equivalent (as mirror images) in size/length/shape of the second longitudinal side edge 128 and the second undrawable width 140, respectively. In other embodiments, the first longitudinal side edge 126 and the first undrawable width 138 are not mirror images of the second longitudinal side edge 128 and the second undrawable width 140, respectively.

The drawcord 134 is operably engaged to the quilt 100. In some embodiments, the drawcord 134 is attached to the outer layer 130 of the quilt 100. In some embodiments, the drawcord 134 is fixed or otherwise secured at drawcord endpoints 300, by stitching, adhesive or the like. In other embodiments, the drawcord 134 can pass through one or more loops 302 that are secured or otherwise attached to outer cover 130. In this embodiment, when the drawcord 134 is drawn, the parts of the quilt 100 connected to the drawcord 134 via the loops 302 will also be drawn medially inward. In another embodiment, the loops 302 can be a tunnel shape, having a longer lateral width as compared to longitudinal width, such that the drawcord is secured within the tunnel 301 formed by loops 302 (as shown in FIG. 12). In some embodiments, the loops 302 forming the tunnel can extending a distance to the first lateral side edge 126 and/or the second lateral side edge 128 to secure ends of the drawcord to the sides of the quilt 100 and away from the user.

In some embodiment, the drawcord 134 is attached to the inner layer 132 of the quilt 100. This embodiment is equivalent to the previous embodiment, except that the drawcord is attached to the inner layer 132 as opposed to the outer layer 130. In yet another embodiment (not shown in the figures), the drawcord is contained mostly inside the quilt 100, in between outer and inner layers 30, 32. In this embodiment, the drawcord can be attached to only the internal surface of the outer layer 30 (i.e., the surface facing inner layer 132), or only to the internal surface of the inner layer 132 (i.e., the surface facing outer surface 130), or to the internal surfaces of both the outer and the inner layers 130, 132. Such an attachment can be made, by way of example, but not limitation, by using loops (not shown) in a manner similar to the loops 302.

In order to effect a drawing action of the drawcord 134, the user pulls on draw tab 144, which is connected to, or a unitary part of, the drawcord 134. In the embodiment in which the drawcord is contained inside the quilt 100, there can be a hole or opening in outer cover 130 or the inner layer 132 to expose the draw tab 144 to allow the user to pull thereon to effect the drawing action. In some embodiments, the draw tab 144 is a cord lock, which operates using a pushbutton to unlock to allow the drawcord 134 to be pulled therethrough, and then locked in place at a desired length or tension. For any embodiment in which the drawcord 134 is contained mostly inside the quilt 100, the draw tab 144 is accessible to the user from outside the quilt 100 either from the outer layer 130 or from the inner layer 132, as described above.

Figure 10:
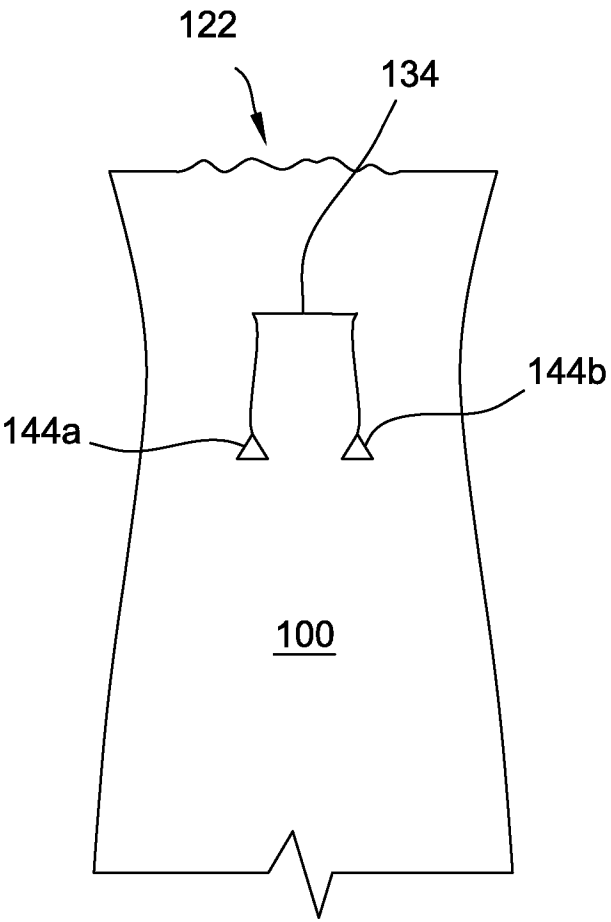
FIG. 10 is an enlarged view of a portion of a quilt in accordance with one or more embodiments of the present disclosure having a drawcord accessible from a single location spaced from the drawcord's center.

In some embodiments, the draw tab 144 is a string with an end piece, illustrated as a triangular end piece, but can be any shape that facilitates grasping by the user. In yet other embodiments, the draw tab 144 can have no end piece. The draw tab(s) 144 (as shown in FIG. 10) can be any shape or configuration that suitably permits a user to move the quilt 100 reversibly between an undrawn position and a drawn position.

Figure 9:
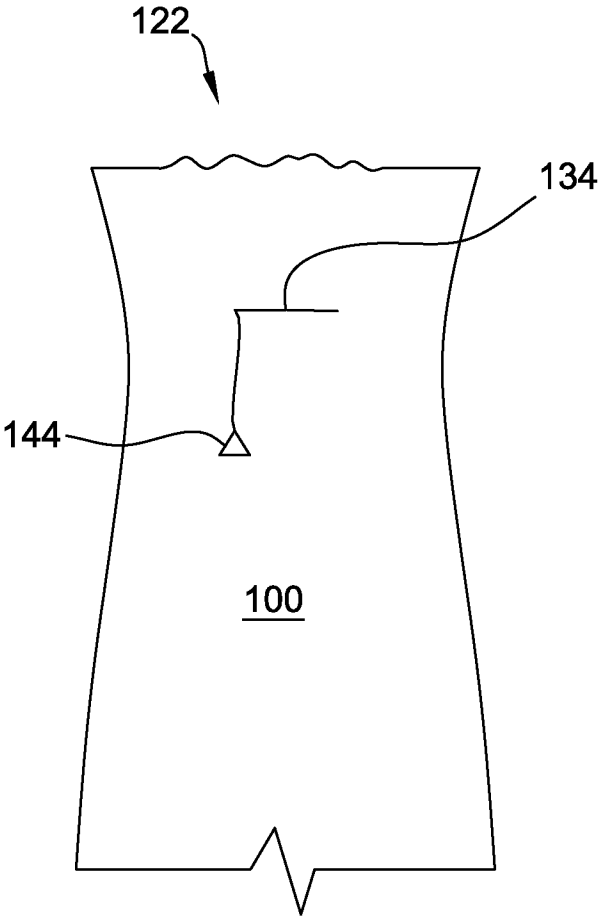
FIG. 9 is a bottom plan view of the quilt of FIG. 1 illustrating an embodiment of the drawcord being in the fully drawn position.
Figure 11:
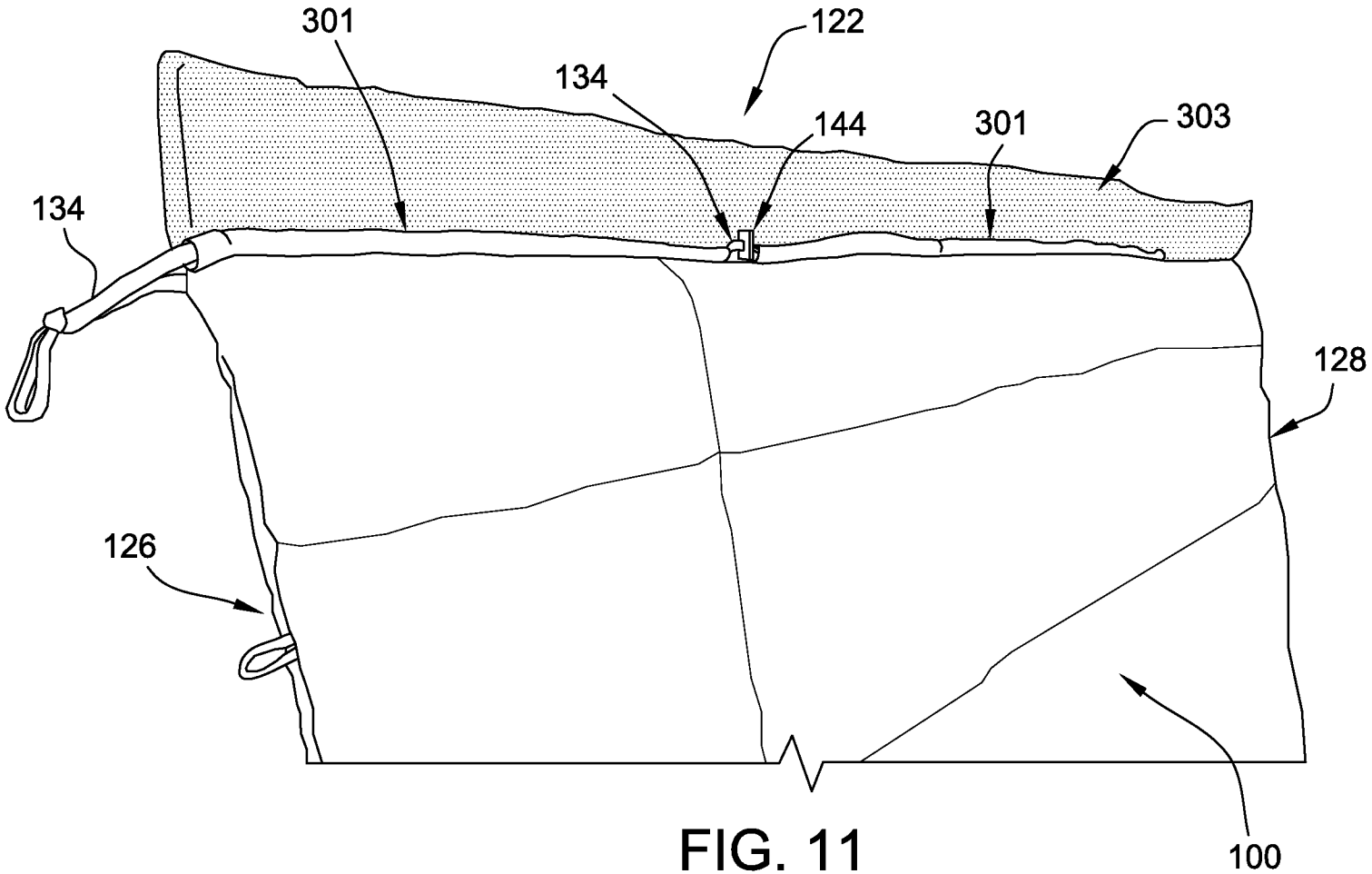
FIG. 11 is an enlarged view of a portion of a quilt in accordance with one or more embodiments of the present disclosure having a drawcord accessible from two different locations spaced from the drawcord's center.

The drawcord 134 is operably connected to the draw tab 144 accessible from a draw location 142. In some embodiments, there is a single draw tab 144, and the draw location 142 is near the center of the drawcord 134. However, it is understood that this is not the only configuration disclosed. In another suitable embodiment, as shown in FIG. 9, the quilt 100 has a single draw tab 144, and the draw location 142 is spaced laterally from the center of the drawcord 134. In yet another suitable embodiment as shown in FIG. 10, the quilt 100 has multiple draw tabs 144*a*, 144*b* accessible from two draw locations 142*a*, 142*b*.

The drawcord 134 can comprise a material such as string, rope, rubber, elastic, or any other suitable material, which can be the same or different as drawcord 134. The draw tab 144 can be integrally connected to the drawcord 134, or the draw tab 144 and drawcord 134 can be operably connected. The draw tab 144 can comprise metal, plastic, or any other suitable material for the drawcord.

Figure 7:
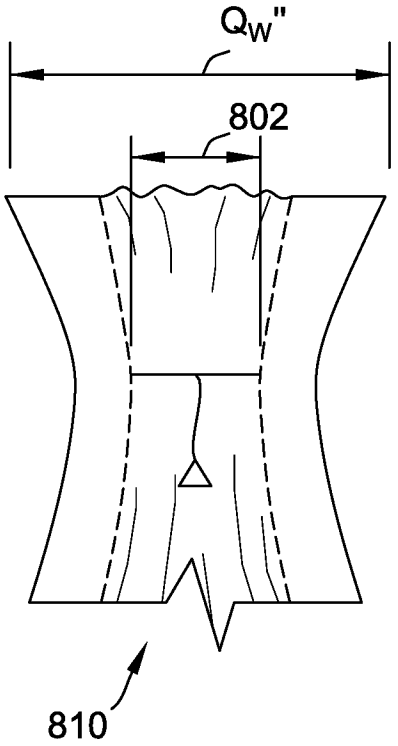
FIG. 7 is an enlarged view similar to FIG. 5 illustrating an embodiment of the drawcord in a fully drawn position.
Figure 6:
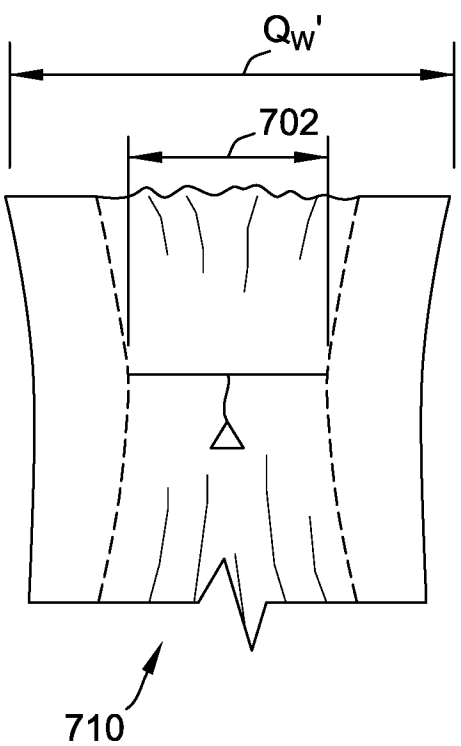
FIG. 6 is an enlarged view similar to FIG. 5 but illustrating an embodiment of the drawcord in a partially drawn position.
Figure 5:
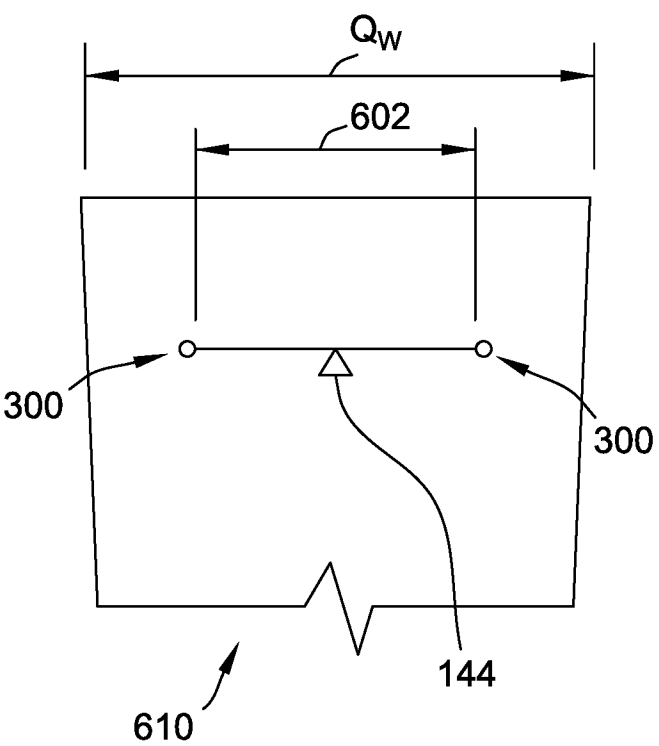
FIG. 5 is an enlarged view of a portion of the quilt of FIG. 2, illustrating an embodiment of a drawcord in an undrawn position.

The quilt 100 is configured such that the user can selectively move a portion of the quilt 100 between an undrawn configuration 610 and a drawn position. An embodiment of an undrawn position 610 is illustrated in FIG. 5, which is a partial view 600 (FIG. 3) of the quilt 100. As used herein, an "undrawn configuration" refers to the quilt 100 in a configuration where the drawcord 134 is at its maximum lateral extent 512 such that the quilt 100 also has its lateral width $Q_W$. An embodiment of a partially drawn configuration 710 is illustrated in FIG. 6, and an embodiment of the fully drawn configuration 810 is illustrated in FIG. 7. To move the quilt 100 from the undrawn configuration 610 to the partially drawn configuration 710, the user draws or pulls on the draw tab 144, which causes the drawcord 134 to pull at fixed points 300 medially inward (i.e., toward a longitudinal center) of the quilt 100. In some embodiments, the drawcord 134 is fixed at only one pull point 300, but in other embodiments the drawcord 134 can be secured at two pull points 300 at opposing ends of the drawcord 134. In some embodiments, the pull point(s) 300 are located in the range of about 4 inches to about 16 inches, such as 6 inches, 8 inches, 10 inches, or 12 inches, medially inward from the first longitudinal side edge 126 and second longitudinal side edge 128, respectively. In the partially drawn configuration 710, a lateral width 602 of the drawcord 134 is reduced to a width 702, which is less than width 602 (of FIG. 5). In the partially drawn configuration 710, the lateral width $Q_W$ of the quilt 100 is also reduced to lateral width $Q_W'$. The quilt 100 can be placed in the fully drawn configuration 810 (of FIG. 7), by the user continuing to pull on the draw tab 144, until the lateral width of drawcord 134 has reached its minimum lateral width 802, at which point the quilt 100 also has its minimum lateral width $Q_W''$.

When the drawcord 134 is at least partially drawn the partially drawn configuration 710, the portion of the quilt 100 that is operably engaged to the drawcord 134 is also drawn medially inwardly. This results in the gathering of a portion 720 of the quilt 100 material around the drawcord 134. The portion 720 of the quilt 100 that gathers when the drawcord 134 is drawn is the gatherable portion 146 as shown in FIG. 1. Since the drawcord 134 does not extend completely to the first or to the second side edges 126, 128, there is a portion of the quilt 100 that does not gather even when the drawcord 134 is fully drawn. The part of the quilt 100 along the first side edge 26 that does not gather when the drawcord 34 is drawn is the first ungatherable portion 148. The part of the quilt 100 along the second side edge 126 that does not gather when the drawcord 134 is drawn is the second ungatherable portion 150. Each of the first ungatherable portion 148 and the second ungatherable portion 150 can have a lateral width in the range of about 2 inches to about 24 inches, and preferably from about 6 inches to about 12 inches. The first ungatherable portion 148 and the second ungatherable portion 150 can thus be tucked under the user, or allowed to naturally fall downward to an underlying surface, such as a mattress, to create a thermal seal.

Figure 8:
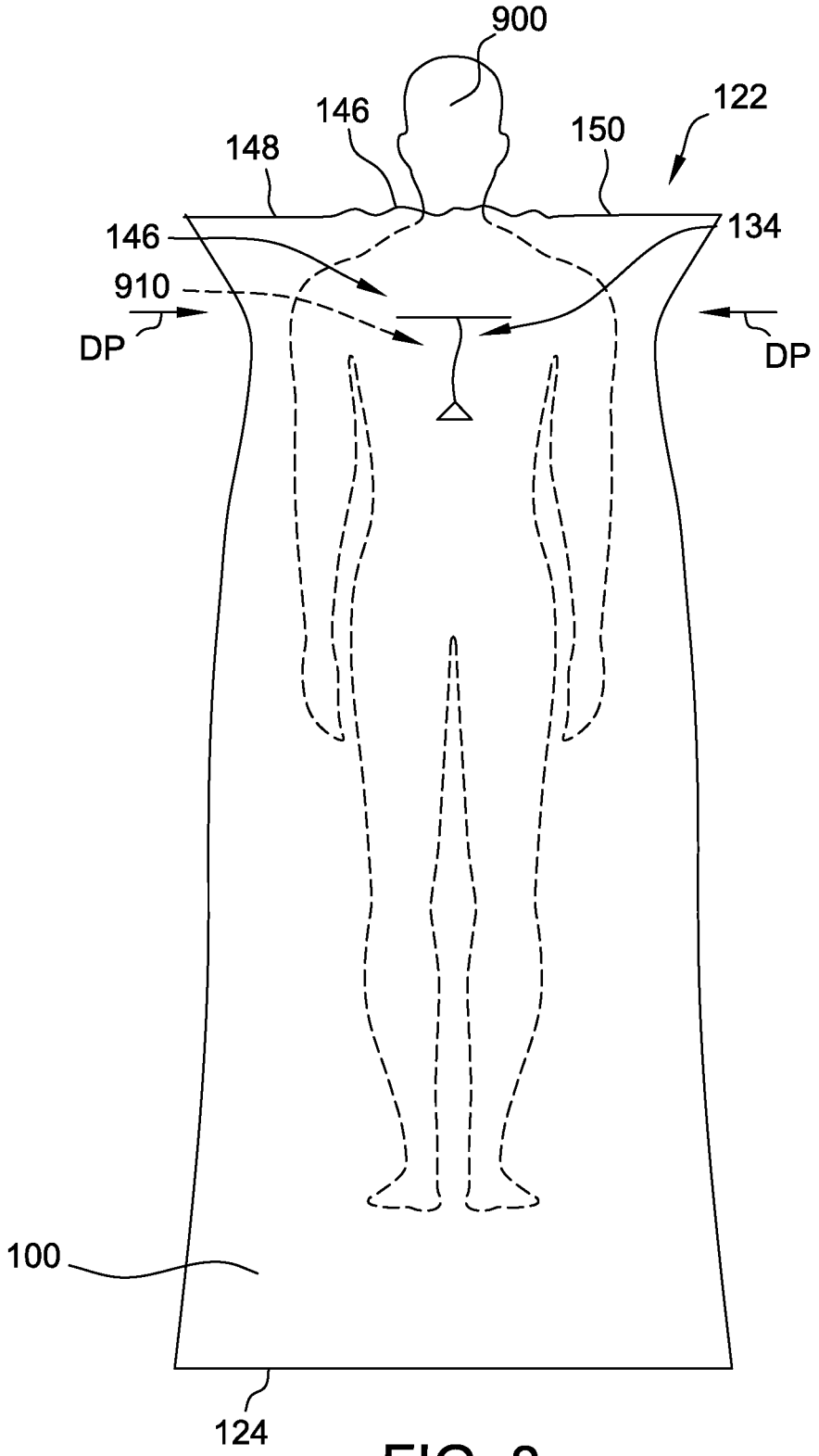
FIG. 8 is a top plan view of the quilt of FIG. 1 illustrating an embodiment of the drawcord being in the fully drawn position.

In use, the quilt 100 of the present disclosure is configured such that the user 900 can rest in a supine fashion (i.e., within cavity 200 as illustrated in FIG. 2) and place the quilt 100 over/around themself, as illustrated in FIG. 8. Where the inner layer 132 faces the user; the outer layer 30 faces outward. The headward end 122 can rest laterally near the user's chin and the footward end 124 can rest longitudinally just beyond the user's feet. The user can draw the drawcord 134 by pulling the draw tab 142. Upon pulling the draw tab 144, the drawn portion 146 moves medially inwardly in the direction of arrows DP to conform to the shape of the user 900. Users can have various reasons for wanting to draw the drawcord 134. Some users may do it for warmth. Others may do it for comfort. Yet others may do it for yet different reasons.

When the drawcord 134 is drawn, the gatherable portion 146 of the quilt 100 can collect, by way of example, but not limitation, on the user's chest area 910. This gathered portion 146 can thus better retain heat around the user's chest area 910 or core and retain heat that would otherwise escape from around the user's neck. The user 900 also enjoys mobility because the drawcord 134 does not span the full width $Q_W$ of the quilt 100, and thus, on either side of the user 900, there can be ungatherable portions 148, 150 that add additional room for mobility to the user 900, or provide additional comfort for the user's shoulders. The ungatherable portions 148, 150 can be freely manipulated by the user. For example, the user 900 can tuck the ungatherable portions 148, 150 underneath the user's pillow or neck for comfort. The user can also fold an ungatherable portion 148 or 150 back over the gatherable portion 146 to expose their shoulder to fresh air. Such a configuration enables the user to have the gathered portion 146 gathered onto their chest to provide fresh air coming in on the user's shoulders.

The user 900 can also selectively undraw or loosen the drawcord 134, returning it to an undrawn configuration 610 (of FIG. 5). In some embodiments, the user 900 can undraw the drawcord 134 by pulling the fixed edges 300 (of FIG. 3) laterally outwardly (i.e., away from a longitudinal center of the quilt 100) to return the quilt 100 to the undrawn configuration 610. If the user 900 is within the cavity 200, the user 900 can, in some embodiments, press laterally outwardly against the first and second lateral side edges 126, 128 to undraw the drawcord 134 and return the quilt 100 to the undrawn configuration 610.

Any one or more materials (e.g., fabrics or insulators) suitable for constructing a conventional sleeping bag or quilt can be employed for constructing one or more components of the quilt 100. Examples of such materials include, but are not limited to nylon, polyester, silk, cotton, taffeta, ripstop, pongee, flannel, microfiber, GORE-tex®, or fleece; natural down, synthetic insulation, or other insulating material; or metal-coated polymer film or other thermally shielding or thermally reflective material. In some embodiments, one or more of the outer layer 130, inner layer 132 or insulating material 135 can include heating elements, e.g., electrical or chemical heating elements.

It is intended that equivalents of the disclosed example embodiments and methods shall fall within the scope of the present disclosure or appended claims. It is intended that the disclosed example embodiments and methods, and equivalents thereof, can be modified while remaining within the scope of the present disclosure or appended claims.

In the foregoing detailed description, various features can be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter can lie in less than all features of a single disclosed example embodiment. Thus, the appended claims are hereby incorporated into the detailed description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112 (f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112 (f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A sleeping quilt comprising: an outer layer having: a first longitudinal edge and an opposing second longitudinal edge; an upper edge and an opposing lower edge, each of the upper edge and the lower edge extending between and terminating at each of the first longitudinal edge and the second longitudinal edge, the upper edge being parallel to the lower edge when the sleeping quilt is in a laid flat arrangement; the outer layer having an undrawn lateral width extending from the first longitudinal edge to the second longitudinal edge; a drawcord having an undrawn lateral width, the drawcord being fixed to the outer layer at a first point and a second point laterally distal to the first point, each of the first point and the second point being located a gap distance medially inward from the first longitudinal edge and the second longitudinal edge, respectively; and a gatherable portion being defined between the first point and the second point, a first ungatherable portion being defined between the first point and the first longitudinal edge and a second ungatherable portion being defined between the second point and the second longitudinal edge, each of the first ungatherable portion and the second ungatherable portion being free of the drawcord, wherein the drawcord is operable to be placed in a drawn configuration to act on and reduce a lateral width of the gatherable portion; such that when the gatherable portion is in the drawn configuration each of the first ungatherable portion and the second ungatherable portion are configured to: freely fall downward to an underlying surface, freely extend outwardly away from a user, or freely tuck under the user, wherein the first ungatherable portion and the second ungatherable portion are configured to create a thermal seal.

2. The sleeping quilt according to claim 1, wherein the drawcord further comprises a drawtab accessible from an exterior of the sleeping quilt, the drawtab operatively attached to the drawcord.

3. The sleeping quilt according to claim 2, wherein the drawcord is configured to pull medially inward upon the user acting on the drawtab.

4. The sleeping quilt according to claim 1, further comprising an inner layer adapted to face the user during use.

5. The sleeping quilt according to claim 4, further comprising an insulating material disposed between the inner layer and the outer layer.

6. The sleeping quilt according to claim 1, wherein the lateral width of the gatherable portion ranges from 6 inches to 18 inches in an undrawn configuration.

7. The sleeping quilt according to claim 1, wherein a lateral width of the first ungatherable portion and the second ungatherable portion each range from 2 inches to 20 inches in an undrawn configuration.

8. The sleeping quilt according to claim 1, wherein the drawcord extends laterally.

9. A sleeping quilt comprising: a drawcord extending laterally across a portion of a width of the sleeping quilt, the drawcord having an undrawn lateral width and a drawn lateral width, the drawcord being fixed to the sleeping quilt at a first point and a second point laterally distal to the first point, each of the first point and the second point being located a gap distance medially inward from a first longitudinal edge and a second longitudinal edge of the sleeping quilt such that the drawcord extends only within the gap distance, wherein the width of the sleeping quilt terminates at each of the first longitudinal edge and the second longitudinal edge; and the sleeping quilt further comprising: a gatherable portion being defined between the first point and the second point, a first ungatherable portion defined between the first point and the first longitudinal edge, and a second ungatherable portion defined between the second point and the second longitudinal edge; such that when the gatherable portion is in the drawn configuration each of the first ungatherable portion and the second ungatherable portion are configured to: freely fall downward to an underlying surface, freely extend outwardly away from a user, or freely tuck under the user, wherein the first ungatherable portion and the second ungatherable portion are configured to create a thermal seal.

10. The sleeping quilt of claim 9, wherein the drawcord passes through one or more loops secured to an outer cover of the sleeping quilt, such that the loops are drawn medially inward by drawing the drawcord.

11. The sleeping quilt of claim 10, wherein the loops form a tunnel shape having a lateral width extending a distance to a first lateral side edge and to a second lateral side edge.

12. The sleeping quit of claim 9, wherein the drawcord includes a draw tab to allow the user to pull thereon to effect a drawing action.

13. The sleeping quilt of claim 12, wherein the drawcord includes a single draw tab accessible from a central draw location, the single draw tab configured to pull the drawcord medially inward.

14. The sleeping quilt of claim 12, wherein the drawcord includes two draw tabs accessible from two draw locations.

15. A sleeping quilt comprising: a first longitudinal edge and an opposing second longitudinal edge; an upper edge and an opposing lower edge, each of the upper edge and lower edge extending between each of the first longitudinal edge and the second longitudinal edge, wherein the upper edge is parallel to the lower edge when the sleeping quilt is in a laid flat arrangement; the sleeping quilt having an undrawn lateral width extending from a first longitudinal edge to an opposing second longitudinal edge; a drawcord extending laterally across a portion of a width of the sleeping quilt, the drawcord having an undrawn lateral width, the drawcord being fixed to the sleeping quilt at a first point and a second point laterally distal to the first point, each of the first point and the second point being located a gap distance medially inward from the first longitudinal edge and the second longitudinal edge of the sleeping quilt; and a gatherable portion defined between the first point and the second point; each of the first point and the second point being located in a range of 4 inches to 16 inches medially inward from the first longitudinal edge and the second longitudinal edge to define the gap distance, the drawcord extends only within the gap distance, wherein the drawcord is operable to be placed in a drawn configuration to act on and reduce the undrawn lateral width of the gatherable portion; such that when the gatherable portion is in the drawn configuration each of a first ungatherable portion and a second ungatherable portion are outboard from the gatherable portion and are configured to: freely fall downward to an underlying surface, freely extend outwardly away from a user, or freely tuck under the user, wherein the first ungatherable portion and the second ungatherable portion are configured to create a thermal seal.

16. The sleeping quilt of claim 15, wherein the gatherable portion of the sleeping quilt conforms to a shape of the user by pulling the drawcord medially.

17. The sleeping quilt of claim 16, wherein the ungatherable portions of the sleeping quilt are freely manipulated by the user.

* * * * *